US011300913B2

(12) United States Patent
Nagata

(10) Patent No.: US 11,300,913 B2
(45) Date of Patent: Apr. 12, 2022

(54) DOCUMENT TRANSPORT DEVICE AND IMAGE FORMING APPARATUS

(71) Applicant: FUJIFILM BUSINESS INNOVATION CORP., Tokyo (JP)

(72) Inventor: Kenjo Nagata, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 404 days.

(21) Appl. No.: 16/521,802

(22) Filed: Jul. 25, 2019

(65) Prior Publication Data

US 2020/0301339 A1 Sep. 24, 2020

(30) Foreign Application Priority Data

Mar. 18, 2019 (JP) ..... JP2019-049711

(51) Int. Cl.

| | |
|---|---|
| ***G03G 15/00*** | (2006.01) |
| ***B65H 29/52*** | (2006.01) |
| ***B41J 13/10*** | (2006.01) |
| ***B65H 43/00*** | (2006.01) |

(52) U.S. Cl.

CPC ..... *G03G 15/607* (2013.01); *B41J 13/103* (2013.01); *B65H 29/52* (2013.01); *B65H 43/00* (2013.01); *G03G 15/6502* (2013.01); *B65H 2301/13* (2013.01); *B65H 2553/45* (2013.01); *B65H 2801/03* (2013.01)

(58) Field of Classification Search

CPC .. G03G 15/00; G03G 15/607; G03G 15/6502; B65H 1/04; B65H 29/52; B65H 43/00; B65H 2301/13; B65H 2553/45; B65H 2801/03; B41J 13/103

See application file for complete search history.

(56) References Cited

U.S. PATENT DOCUMENTS 10,459,394 B2 * 10/2019 Morita ..... B65H 1/04

FOREIGN PATENT DOCUMENTS

| | | | | |
|---|---|---|---|---|
| JP | H10-212037 A | | 8/1998 | |
| JP | 2004-256209 A | | 9/2004 | |
| JP | 2007-15776 A | | 1/2007 | |
| JP | 2007028515 A | * | 2/2007 | ..... G03G 15/00 |
| JP | 2010-58889 A | | 3/2010 | |

* cited by examiner

*Primary Examiner* — Nguyen Q. Ha
(74) *Attorney, Agent, or Firm* — Oliff PLC

(57) ABSTRACT

A document transport device includes a placement portion, a slide member, a movable piece, and a detector. A document is to be placed on the placement portion. The slide member includes a document guide that contacts one lateral side of the document which is placed on the placement portion. The movable piece is provided to the slide member, and includes a shading pattern composed of plural patches that have plural densities corresponding to plural document sizes and having plural adjacent patch density differences that are different from each other. The detector detects a density of the shading pattern, and outputs an output signal for document size recognition.

14 Claims, 12 Drawing Sheets

DOCUMENT TRANSPORT DEVICE AND IMAGE FORMING APPARATUS

CROSS-REFERENCE TO RELATED APPLICATIONS

This application is based on and claims priority under 35 USC 119 from Japanese Patent Application No. 2019-049711 filed Mar. 18, 2019.

BACKGROUND

(i) Technical Field

The present disclosure relates to a document transport device and an image forming apparatus that includes the document transport device.

(ii) Related Art

In general, an image forming apparatus includes a document transport device that automatically feeds a document to a document reader. The document transport device is also called an automatic document feed device or an auto document feeder (ADF).

The document transport device includes a placement portion that extends in an x direction, which is the transport direction for a document, and a y direction, which is orthogonal to the x direction, and first and second slide members that slide in the y direction symmetrically with reference to the center position in the y direction, for example. The first slide member includes a first document guide. The second slide member includes a second document guide. The slide positions of the two slide members in the y direction are adjusted such that the spacing between the first and second document guides conforms to the y-direction size of the document which is placed on the placement portion, or in other words two lateral sides of the document contact the first and second slide members.

The image forming apparatus is normally provided with a document size recognition unit that recognizes the size (in particular, the y-direction size) of the document which is set to the document transport device. Japanese Unexamined Patent Application Publication No. 2007-15776 discloses a document size recognition unit that includes a plate that moves together with a document guide, and a plurality of sensors that detect the position of the plate. The plate and the plurality of sensors function as a detection section in the document size recognition unit. Specifically, the plate is formed with a plurality of grooves, and the plurality of sensors are provided at positions corresponding to the plurality of grooves. The size of the document is recognized on the basis of an output signal from the plurality of sensors. Japanese Unexamined Patent Application Publication No. 10-212037 and Japanese Unexamined Patent Application Publication No. 2004-256209 disclose a paper size recognition unit provided to a paper feed tray.

SUMMARY

In the document transport device, it is necessary to recognize the size of the document which is placed on the placement portion. It is conceivable to provide, as the document size recognition unit, an optical pattern that moves together with a slide member with a document guide and a detector that detects the density of the pattern at a reading location. In that case, the document size may be erroneously recognized if the density of the pattern is varied stepwise with constant density differences in the order of the document size.

Aspects of non-limiting embodiments of the present disclosure relate to enhancing the precision in recognizing the document size in a document transport device or an image forming apparatus that includes the document transport device.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a document transport device including: a placement portion on which a document is to be placed; a slide member that includes a document guide that contacts one lateral side of the document which is placed on the placement portion; a movable piece provided to the slide member and including a shading pattern composed of a plurality of patches that have a plurality of densities corresponding to a plurality of document sizes and having a plurality of adjacent patch density differences that are different from each other; and a detector that detects a density of the shading pattern and that outputs an output signal for document size recognition.

BRIEF DESCRIPTION OF THE DRAWINGS

An exemplary embodiment of the present disclosure will be described in detail based on the following figures, wherein.

DETAILED DESCRIPTION

Figure 1:
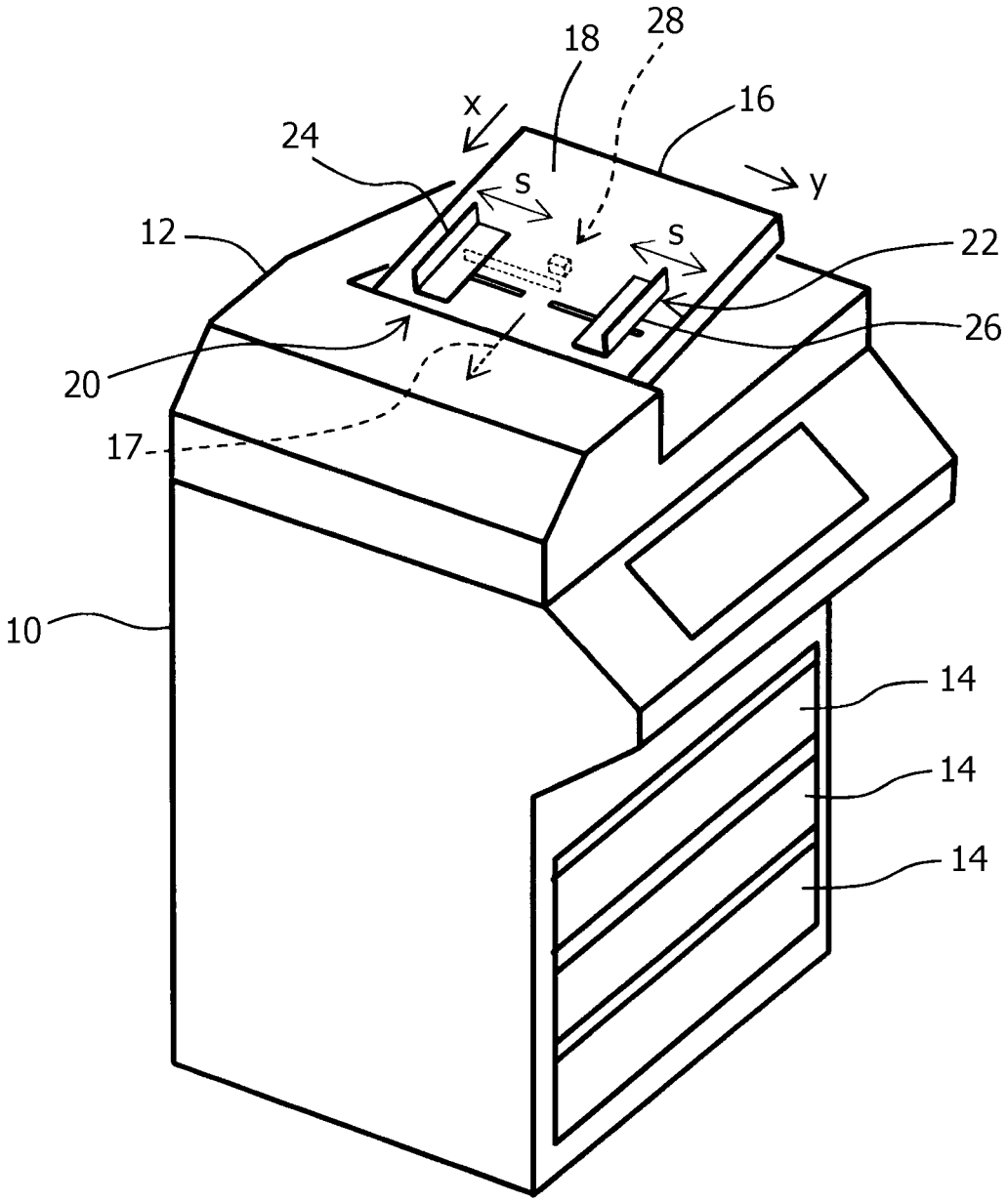
FIG. 1 is a perspective view illustrating an image forming apparatus according to an exemplary embodiment.

An exemplary embodiment will be described below with reference to the drawings.

(1) Overview of Exemplary Embodiment

A document transport device according to an exemplary embodiment includes: a placement portion on which a document is to be placed; a slide member that includes a document guide; a movable piece that includes a shading pattern; and a detector that detects a density of the shading pattern. The document guide guides movement of the document while contacting one lateral side of the document. In the case where a direction that is orthogonal to the transport direction for the document is defined as an orthogonal direction, the one lateral side is one of two lateral sides of the document distanced from each other in the orthogonal direction. The slide member is provided with the movable piece, which slides together with the slide member. The shading pattern, which is provided to the movable piece, includes a plurality of patches that have a plurality of densities corresponding to a plurality of document sizes. The shading pattern includes a plurality of adjacent patch density differences that are different from each other.

In the configuration described above, the density of the shading pattern is detected by the detector. Consequently, the size of the document which is placed on the placement portion is recognized. The shading pattern includes a plurality of adjacent patch density differences that are different from each other. That is, the plurality of adjacent patch density differences which are included in the shading pattern are not uniform. Therefore, a large adjacent patch density difference may be provided between particular adjacent patches, for which it is desirable to enhance the recognition precision.

The individual patches are objects to be detected or pattern elements that have allocated peculiar densities. The form of the patches may be determined freely as long as the document size may be recognized. The shading pattern is composed of a plurality of patches arranged in the slide direction of the slide member (i.e. the orthogonal direction described above). From such a point of view, the shading pattern corresponds to a patch row.

In general, the document size recognition unit is composed of a detection section and a recognition unit. In an exemplary embodiment, the detection section is composed of a shading pattern and a detector, which are provided in the document transport device. The recognition unit is provided in the document transport device, or provided at a different portion in an image forming apparatus. In the case where a pair of slide members that are movable in the slide direction symmetrically with reference to the center in the slide direction are provided, the detection section is provided to either of the slide members. Two detection sections may be provided to the two slide members.

In an exemplary embodiment, the plurality of document sizes include a particular size pair composed of two adjacent document sizes in a predetermined approximate relationship. The shading pattern includes, as a patch pair corresponding to the particular size pair, a particular patch pair that has a particular adjacent patch density difference that is larger than an average of the plurality of adjacent patch density differences.

In the case where the reading point, which is the position of the shading pattern which is read by the detector, is located on two patches because of a factor such as a positioning error, a density (i.e. the middle density) between the two densities of such patches tends to be detected. In particular, the middle density tends to be detected in the case where the sizes of the two patches are approximate to each other. If the density difference between the densities of the two patches is large, in contrast, the middle density is varied significantly with respect to variations in the position of the reading point. Therefore, even if the middle density is caused, there is a higher possibility that the middle density is close to either of the densities of the two patches. The predetermined approximate relationship is typically the most approximate relationship, but may be the second most approximate relationship etc. In the case where the number of the patches is n, the average described above may be calculated by dividing the integral of (n−1) adjacent patch density differences by (n−1).

In an exemplary embodiment, the predetermined approximate relationship is the most approximate relationship. The particular adjacent patch density difference is the largest adjacent patch density difference of the plurality of adjacent patch density differences. This configuration provides the largest adjacent patch density difference to a portion, for which it is most likely that the middle density is caused. Conversely, it is desirable to provide a small adjacent patch density difference to a portion, for which it is unlikely that the middle density is caused.

The shading pattern may include a plurality of separation bands provided between a plurality of adjacent patches. The individual separation bands function as markers indicating that the location is between the patches. Therefore, the individual separation bands are configured such that the function of the separation bands is demonstrated effectively. For example, the separation bands are constituted as black bands. The black bands are formed to be thicker than the highest density among the plurality of densities of the plurality of patches, for example.

In the case where a plurality of separation bands are provided in the shading pattern, a detector that may detect the density of an object to be detected and recognize that the object to be detected is a separation band is provided. For example, a detector that includes a principal light receiver and a sub light receiver is provided. The principal light receiver detects diffused light from the reading point. The sub light receiver detects regularly reflected light from the reading point. The size of the document is recognized on the basis of an output signal from the principal light receiver and the sub light receiver.

The regularly reflected light is known to be sensitive to the density (in particular, a black layer) compared to the diffused light. For example, the intensity of the regularly reflected light from a black band is considerably low compared to the intensity of the regularly reflected light from other portions. The configuration described above uses such a feature to enhance the precision in specifying whether or not the reading point is in a separation band, that is, whether or not the reading point is between the patches.

Even if a separation band is provided between the patches, there may be a possibility that the reading point is located on the two patches beyond the separation band. Even in the case where a separation band is provided, it is desirable that the patch density difference between particular adjacent patches should be increased.

An auxiliary pattern may be provided in parallel with the shading pattern. In that case, the auxiliary pattern includes a plurality of separation bands corresponding to locations between a plurality of adjacent patches. The detector detects the density of the shading pattern at the reading point and the density of the auxiliary pattern at the reading point. Also with this configuration, the individual patches are recognized through detection of the individual separation bands. An auxiliary pattern that has one or a small number of separation bands may be provided. That is, the separation bands may be provided only at locations at which it is necessary for the separation bands to demonstrate the function thereof.

In an exemplary embodiment, the movable piece includes a front surface that faces a downstream side in a transport direction and a rear surface on a side opposite to the front surface. The shading pattern is provided on the rear surface of the movable piece. The detector is provided on a rear side of the movable piece to face the shading pattern. In many cases, there is more space available on the upstream side in the transport direction in the internal space of the document tray compared to the downstream side in the transport direction. The configuration described above is suitable for such a situation. The placement portion corresponds to the top plate of the document tray.

In an exemplary embodiment, a body of the slide member is provided so as to be slidable while being pressed against a back surface of the placement portion, and the detector is fixed to the back surface of the placement portion. The slide member is provided with the movable piece. In the configuration described above, the movable piece and the detector are positioned with respect to a common member.

In an exemplary embodiment, the placement portion has a slit that allows passage of a part of the slide member. The shading pattern is provided at a position shifted in a transport direction from a location below the slit. In the case where the placement portion is in the normal posture, foreign matter such as dust easily intrudes via the slit.

In an exemplary embodiment, the shading pattern is in a parallel relationship with respect to a plane defined by a direction that is orthogonal to a transport direction for the document and a direction that perpendicularly penetrates the placement portion. With such a configuration, foreign matter does not easily adhere onto the surface of the shading pattern in the case where the placement portion is in the normal posture. For example, the shading pattern may be considered to be in a parallel relationship in the case where the rotational angle of the shading pattern with respect to a reference plane about a rotational axis that is parallel to the orthogonal direction (i.e. the slide direction) is in the range of ±20 degrees, for example. In any case, it is desirable that the shading pattern should be provided such that the shading pattern is not directed upward in the vertical direction in the normal posture. The transport direction corresponds to the x direction to be discussed later. The orthogonal direction corresponds to the y direction to be discussed later. The penetrating direction corresponds to the z direction to be discussed later.

In an exemplary embodiment, the shading pattern is provided at a position shifted toward an upstream side in a transport direction from a location below the slit. The detector is provided at a position further shifted toward the upstream side in the transport direction with respect to the shading pattern. A rotary shaft is provided at an end portion of the placement portion on a downstream side in the transport direction.

In the case where the rotary shaft is provided on the downstream side of the document tray, there is not much space available on the downstream side in the internal space of the document tray. On the other hand, there tends to be more space available on the upstream side in the internal space of the document tray. The detection section is preferably provided at a position away from the slit in consideration of the possibility that foreign matter intrudes via the slit. Further, foreign matter does not easily reach the detection section which is located on the upper side with respect to the slit if an end portion of the placement portion on the upstream side is flipped upward. In the configuration described above which includes such features, the shading pattern is provided on the upstream side with respect to the slit, and the detector is provided further on the upstream side with respect to the shading pattern.

In an exemplary embodiment, the movable piece is provided between the slit and the detector to extend in a direction that is orthogonal to the transport direction and a direction that penetrates the placement portion. As seen from the detector, the movable piece functions as a partition or a guard plate, which makes it difficult for foreign matter to reach the detector.

An image forming apparatus according to an exemplary embodiment includes a document transport device and a control section. The document transport device includes the placement portion, the slide member, the movable piece which includes the shading pattern, and the detector described above. The control section recognizes a size of the document on the basis of an output signal from the detector.

(2) Details of Exemplary Embodiment

FIG. 1 schematically illustrates an image forming apparatus according to an exemplary embodiment. The image forming apparatus is a so-called multi-function device that includes a copy function, a print function, a scanner function, etc. The configuration described below may be applied to an image forming apparatus that includes a particular function, among such functions.

The image forming apparatus includes a body 10 and a document transport device 12. The body 10 includes a plurality of paper feed cassettes 14. A mechanism that forms an image on paper is provided in the body 10. A control section that controls image forming operation is also provided in the body 10.

The document transport device 12 is a mechanism that sequentially takes out documents from a set document bundle and that sequentially feeds the documents to an image reading section. The device is also called an ADF. One document is occasionally set to the document transport device 12. A rotary shaft 21 of the document transport device 12 is provided on the back side of the body 10.

The document transport device 12 includes a document tray 16. The top plate of the document tray 16 functions as a placement portion 18. A document to be read is placed on the placement portion 18. More specifically, the upper surface of the placement portion 18 functions as a tray surface for placement of the document. In FIG. 1, reference numeral 17 denotes a direction (i.e. a document transport direction) in which the document is transported. A direction that is parallel to the document transport direction 17 is defined as an x direction. A direction that is orthogonal to the document transport direction is defined as a y direction. A direction that is orthogonal to the x direction and the y direction is defined as a z direction. In FIG. 1, the z direction is not indicated.

The placement portion 18 extends in both the x direction and the y direction. When the document tray 16 is in the normal posture, the document tray 16 is inclined with the downstream side thereof in the transport direction 17 slightly lowered. The document tray 16 may be in a flip-up posture with the upstream side of the document tray 16 in the transport direction 17 lifted as necessary.

The document transport device 12 includes two slide members 20 and 22. The slide member 20 includes a document guide 24 that contacts one lateral side of the document to guide movement of the document. The slide member 22 includes a document guide 26 that contacts the other lateral side of the document to guide movement of the document. The two document guides 24 and 26 are moved closer to or away from each other in the y direction, which is the slide direction, symmetrically with reference to the center position in the y direction. Such interlocked slide motion is indicated by symbol s in FIG. 1. The positions of the two document guides 24 and 26 are adjusted manually such that the spacing between the two document guides 24 and 26 coincides with the size of the document in the y direction.

The image forming apparatus according to the exemplary embodiment includes a document size recognition unit. The document size recognition unit is roughly composed of a detection section 28 and a recognition unit. In the exemplary embodiment, the detection section 28 is provided to the document transport device 12, and the recognition unit is implemented as a function of a control section to be discussed later.

The detection section 28 is represented schematically in FIG. 1. Specifically, the detection section 28 is composed of a shading scale and a detector. The shading scale is provided on one surface of a movable piece, which is integrated with the slide member 20. The movable piece may be considered as a part of the detection section 28. The document tray 16 and the detection section 28 will be principally described below.

Figure 2:
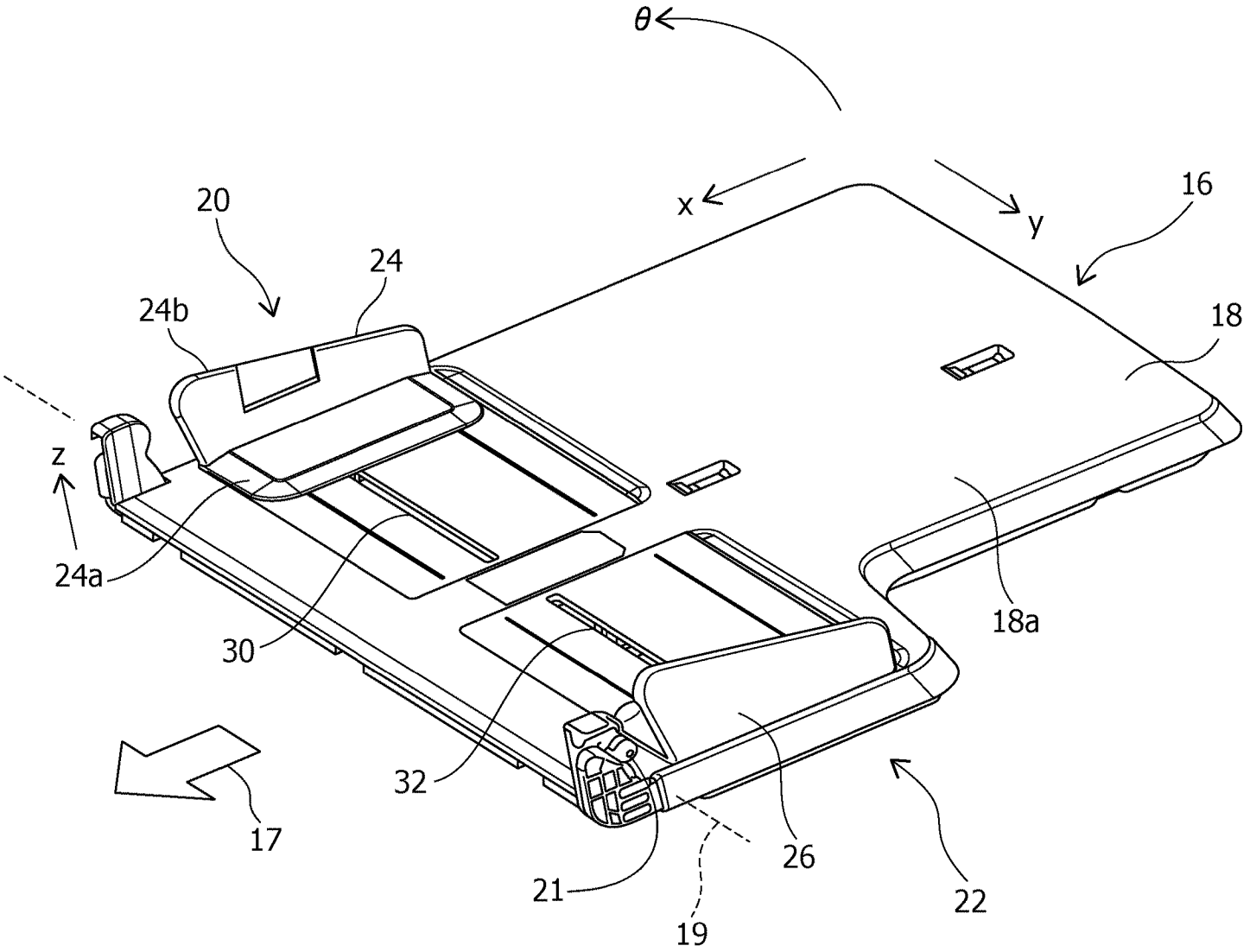
FIG. 2 is a perspective view of a document tray.

FIG. 2 illustrates the upper surface side of the document tray 16. As described already, the document tray 16 includes the placement portion 18, and the upper surface of the placement portion 18 constitutes a tray surface 18*a* that serves as a placement surface. The tray surface 18*a* extends in the x direction and the y direction.

The slide member 20 includes a body positioned on the lower side of the placement portion 18, the document guide 24 which is positioned on the upper side of the placement portion 18, and a middle portion that connects between the body and the document guide 24. The middle portion penetrates a slit 30. The slide member 22 is constituted similarly to the slide member 20. That is, the slide member 22 includes a body positioned on the lower side of the placement portion 18, the document guide 24 which is positioned on the upper side of the placement portion 18, and a middle portion that connects between the body and the document guide 24. The middle portion penetrates a slit 32. The document guide 24 is composed of a horizontal portion 24*a* that extends in the x direction and the y direction, and a vertical portion 24*b* that extends in the x direction and the z direction. The document guide 26 is formed similarly to the document guide 24.

The slits 30 and 32, which are arranged on a line along the y direction, are each an opening elongated in the y direction. The document tray 16 is provided so as to be rotatable about a rotational axis 19. That is, a rotary mechanism is provided at an end portion of the document tray 16 on the downstream side in the transport direction. The document tray 16 is rotatable as indicated by symbol θ in FIG. 2.

Figure 3:
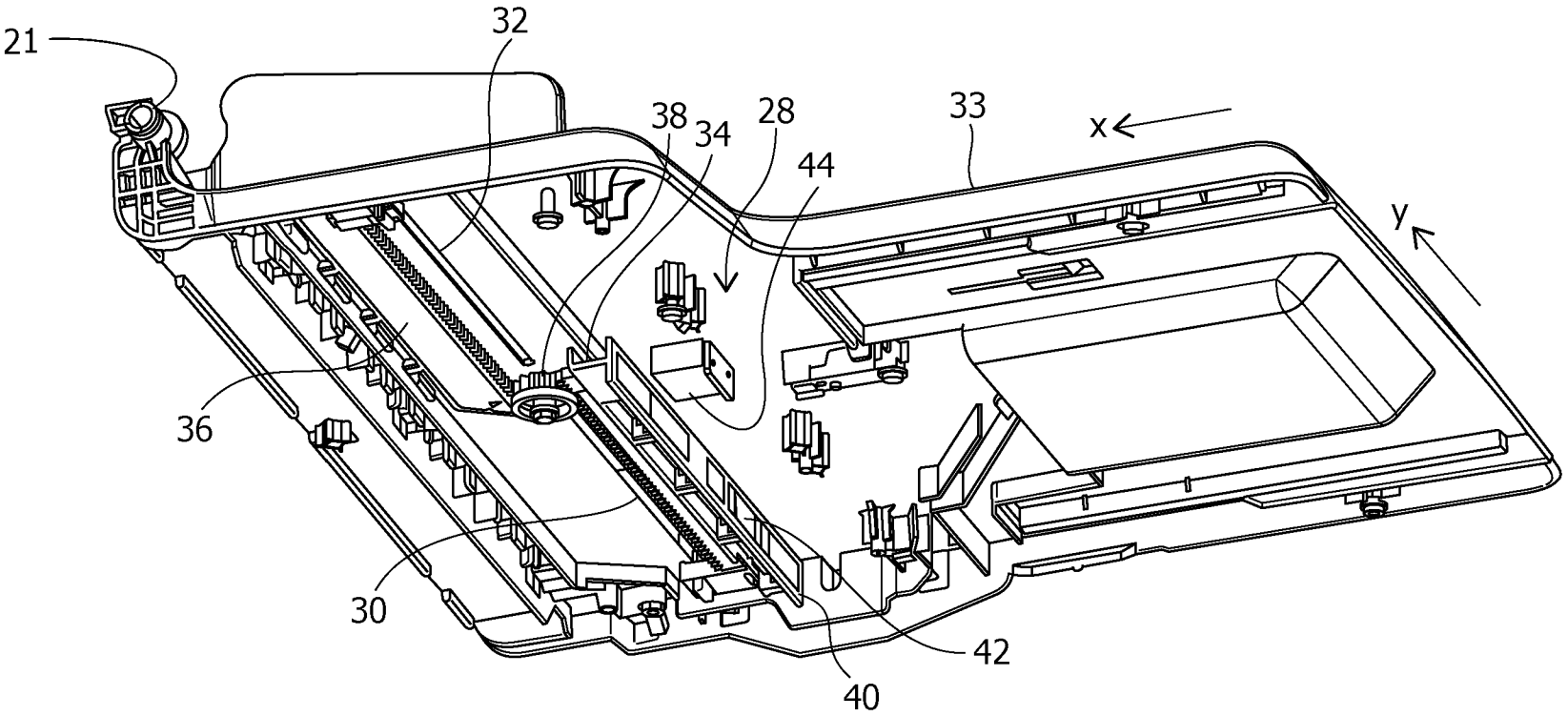
FIG. 3 is a perspective view illustrating the inside of the document tray.

FIG. 3 illustrates the lower side of the document tray. The lower side of an upper case 33 is covered by a lower case. In FIG. 3, however, the lower case is not illustrated. The upper case 33 and the lower case constitute a housing for the document tray.

The two slide mechanisms include bodies 34 and 36. The bodies 34 and 36 are each a rack plate on which a rack as a linear gear is formed. The two racks are meshed with a pinion 38 provided at the middle while facing each other. In FIG. 3, the body 34 is provided at a position shifted toward the downstream side in the transport direction from the slit 30. The body 36 is provided at a position shifted toward the upstream side in the transport direction from the slit 32. A movable piece 40 is fixed to the body 34. The movable piece 40 has a front surface that faces the downstream side in the transport direction, and a rear surface that faces the upstream side in the transport direction.

The detection section 28 is provided inside the document tray. The detection section 28 includes a shading pattern 42 provided on the rear surface of the movable piece 40, and a detector 44 that detects the density of the shading pattern 42 at a reading point. The detector 44 includes a light emitter that radiates light to the reading point, and a light receiver that receives light from the reading point. Examples of the detector 44 include a light detector that emits and receives near infrared rays etc.

Figure 4:
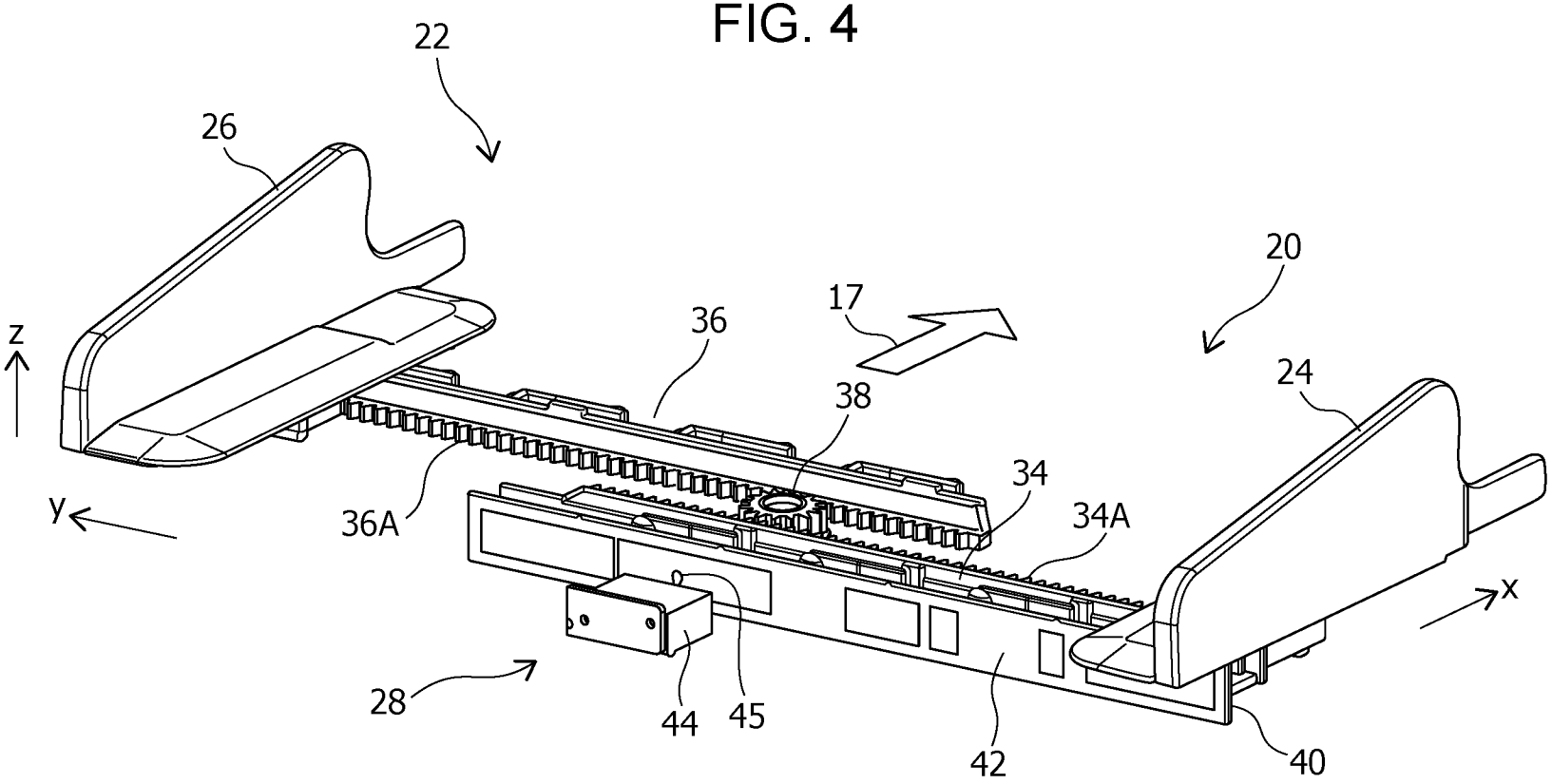
FIG. 4 is a perspective view illustrating a pair of slide members and a detection section.

FIG. 4 illustrates the two slide members 20 and 22 and the detection section 28. FIG. 4 illustrates the components as seen from the downstream side in the transport direction. The slide member 20, which is positioned on the back side of the image forming apparatus, includes the body 34 which serves as a rack plate, the document guide 24, and the middle portion which connects between the body 34 and the document guide 24. The movable piece 40 is fixed to the body 34. The slide member 22, which is positioned on the front side of the image forming apparatus, includes the body 36, the document guide 26, and the middle portion which connects between the body 36 and the document guide 26.

The body 34 is formed with a rack 34A, which faces the downstream side in the transport direction. The body 36 is formed with a rack 36A, which faces the upstream side in the transport direction. The racks 34A and 36A are meshed with the pinion 38. The pinion 38 is rotatably fixed at the center position in the y direction. For example, when the slide member 20 is slid, the slide member 22 is slid by the same amount in the direction opposite to the direction in which the slide member 20 is moved. Similarly, when the slide member 22 is slid, the slide member 20 is slid by the same amount in the direction opposite to the direction in which the slide member 22 is moved.

On the assumption of such a relationship, one detection section 28 is provided. That is, the size of the document in the y direction is detected using the one detection section 28. In the exemplary embodiment, the movable piece 40 is fixed to the slide member 20. However, the movable piece 40 may be fixed to the slide member 22.

The shading pattern 42 is used to specify the size of the document which is currently set, from among a plurality of document sizes that are recognizable, and includes a plurality of patches corresponding to the plurality of document sizes. The individual patches are given respective peculiar densities. Such a feature will be discussed in detail later. A reading point 45 is formed on the shading pattern 42 by the detector 44. The reading point 45 has a diameter of 0.5 to several millimeters. The width of the shading pattern 42 in the y direction is 150 mm, for example. The size of the shading pattern 42 in the height direction is 5 mm, for example. The distance between the front surface of the detector 44 and the shading pattern 42 is set in the range of 1 to 10 mm, for example. The thickness of the movable piece 40 is 1 mm, for example. All the numerical values given herein are merely exemplary.

Figure 5:
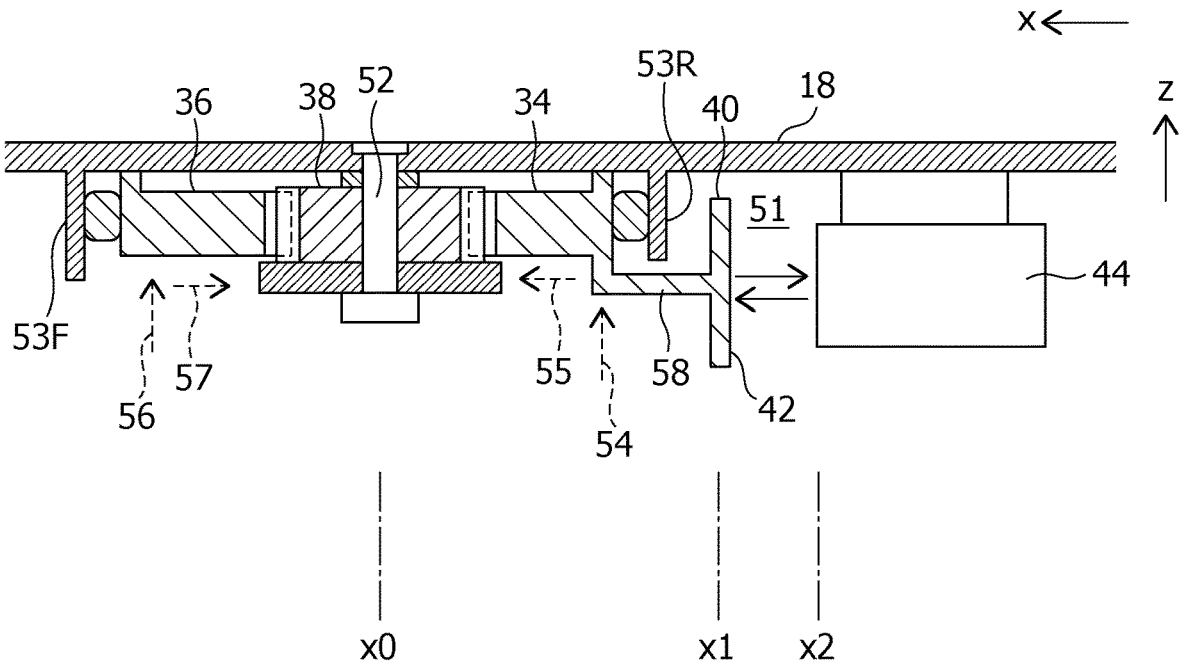
FIG. 5 is a sectional view of the document tray.

FIG. 5 schematically illustrates a sectional surface of the document tray. A shaft 52 is attached to the placement portion 18. The pinion 38 is rotated about the shaft 52. Walls 53R and 53F that extend in the y direction and the z direction are provided on the back surface of the placement portion 18. The body 34 is provided between the wall 53R and the pinion 38. The body 36 is provided between the wall 53F and the pinion 38. An upward elastic urging force 54 is applied to the body 34 by a spring member or the like (not illustrated). An elastic urging force 55 toward the pinion 38 in FIG. 5 is applied to the body 34 by an elastic portion of the body 34 itself. Similarly, an upward elastic urging force 56 is applied to the body 36 by a spring member or the like (not illustrated). An elastic urging force 57 toward the pinion 38 in FIG. 5 is applied to the body 36 by an elastic portion of the body 36 itself.

The movable piece 40 is fixed to the body 34 via a connecting portion 58. Specifically, the connecting portion 58 enters a space 51 from a space in which the body 34 is present through the lower side of the wall 53R. The movable piece 40 is fixed to an end portion of the connecting portion 58. The movable piece 40 is formed as a plate that extends in the y direction and the z direction, and has a front surface that faces the upstream side and a rear surface that faces the downstream side. The shading pattern 42 is provided on the rear surface of the movable piece 40.

The detector 44 is provided on the rear side (i.e. the downstream side) of the shading pattern 42. The detector 44 is fixed to the back side of the placement portion 18 so as to directly face the shading pattern 42. The detector 44 is provided at the center position in the y direction, or at a position shifted in the y direction from the center position in accordance with the shifted arrangement of the shading pattern. Since both the movable piece 40 and the detector 44 are positioned on the back surface of the placement portion 18, the spatial relationship between the movable piece 40 and the detector 44 is easily made adequate.

In the x direction, symbol x0 indicates the position at which the pinion 38 is provided. The slit discussed above is formed at that position. Symbol x1 indicates the position at which the movable piece, that is, the shading pattern 42, is provided. Symbol x2 indicates the position of the front surface of the detector 44.

In the exemplary embodiment, the movable piece 40 is provided at a position shifted downstream from the position x0 at which the slit is provided, and the detector 44 is provided at a position further shifted downstream therefrom. The shading pattern 42 is formed on the rear surface of the movable piece 40. The shading pattern 42 is parallel to a plane defined by the y direction and the z direction. The shading pattern 42 is close to a vertical surface even if the document tray is inclined in the normal posture.

Figure 6:
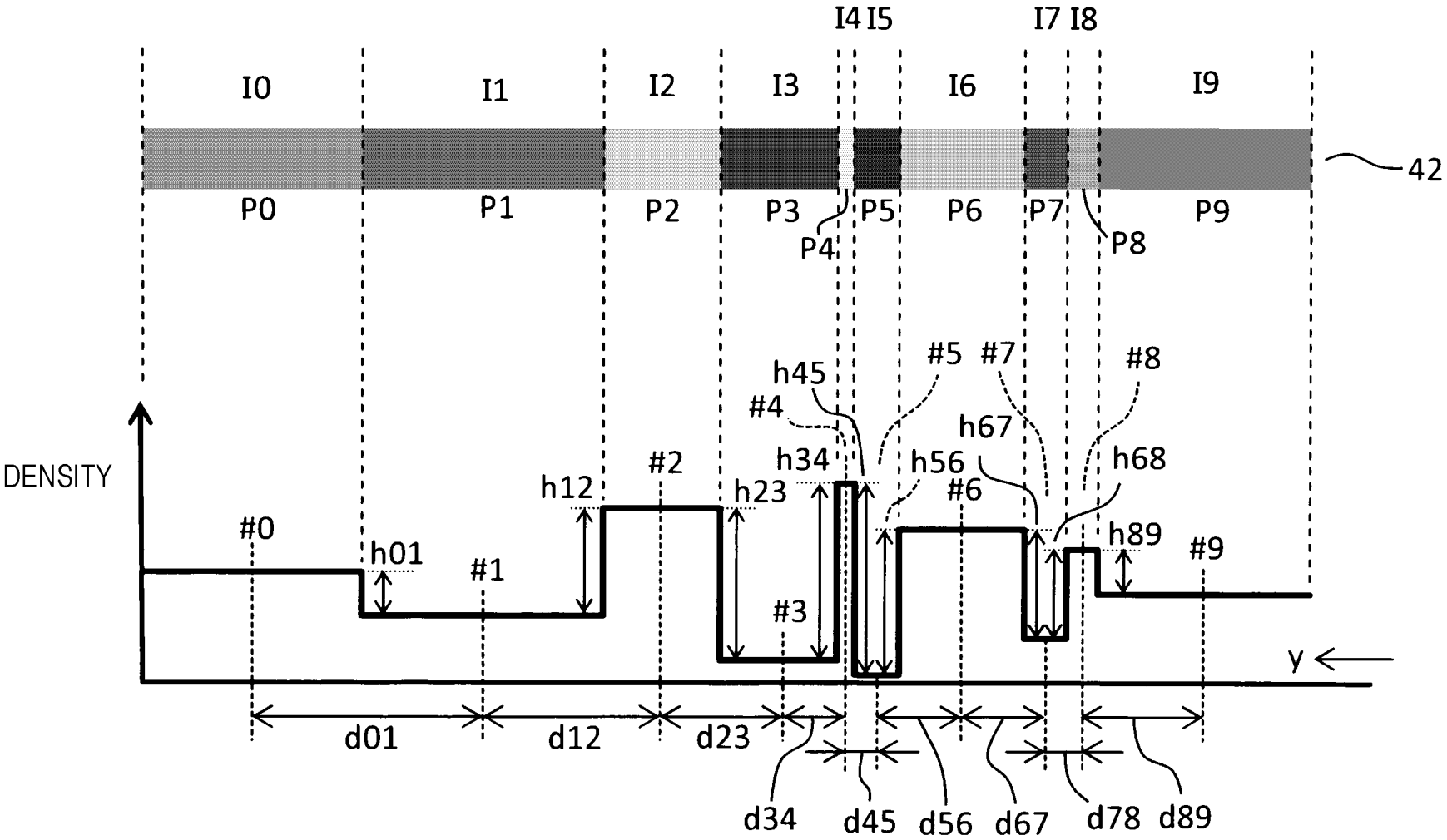
FIG. 6 illustrates a first example of a shading pattern.

Next, a first example of the shading pattern will be described with reference to FIG. 6. The upper part of FIG. 6 illustrates the shading pattern 42. The lower part of FIG. 6 illustrates a graph that indicates variations in the density of the shading pattern 42 in the y direction.

The shading pattern 42 is composed of a plurality of patches arranged in the y direction. Specifically, in the illustrated example, the shading pattern 42 is composed of ten patches from a patch P0 to a patch P9. The patches P0 to P9 are given different densities I0 to I9, respectively, that are different from each other. In the y direction, the patches P0 to P9 include respective sizes to be recognized. The respective centers of the patches P0 to P9 are denoted by #0 to #9. For convenience, symbols #0 to #9 may be understood as the document sizes to be recognized. Symbols d01 to d89 denote nine adjacent patch distances. The adjacent patch distance is the distance between the patch centers of two adjacent patches. Symbols h01 to h89 denote adjacent patch density differences. The adjacent patch density difference is the distance between the two densities of two adjacent patches.

In the case where two adjacent document sizes are defined as a size pair, a plurality of size pairs are constituted on the basis of a plurality of sizes to be recognized. In the exemplary embodiment, a particular size pair of sizes that are the closest to each other, among the plurality of size pairs, is a size pair of a size that belongs to the patch P4 and a size that belongs to patch P5. A particular adjacent patch distance corresponding to the particular size pair is d45.

In the case where the reading point is moved from the inside of one patch to the inside of the other patch, the detected density is continuously varied from the density of the one patch to the density of the other patch. In that event, the middle density is continuously varied between the two densities. As the adjacent patch density difference is larger, the density is varied more steeply.

In the exemplary embodiment, on the basis of the above concept, a relatively large adjacent patch density difference is provided between the particular adjacent patches corresponding to the particular size pair of sizes that are the closest to each other, that is, between the patch P4 and the patch P5. Specifically, at least an adjacent patch density difference that is equal to or more than the average of the adjacent patch density differences is provided between the particular adjacent patches. In practice, the largest adjacent patch density difference h45 is provided between the particular adjacent patches. In the case where the number of the patches is n, the average is calculated by dividing the integral of (n−1) adjacent patch density differences by (n−1).

If there is another size pair that is likely to cause erroneous recognition, it is desirable to provide a large adjacent patch density difference between adjacent patches corresponding to such a size pair. For example, in the illustrated example, the second largest adjacent patch density difference h34 is provided between the patch P3 and the patch P4. Conversely, a small adjacent patch density difference is provided between adjacent patches corresponding to a size pair that is unlikely to cause erroneous size recognition.

In the exemplary embodiment, in this manner, a plurality of adjacent patch density differences are assigned to a plurality of adjacent patches such that the possibility of erroneous recognition is reduced for the entirety of a plurality of sizes in accordance with the possibility of erroneous size recognition.

A patch correlated with a size group may be included in the plurality of patches. In the case where a size group is specified on the basis of a detected density, the actual size is recognized from the size group by a different method. In that case, the size group is treated as one size from the viewpoint of recognition by the detection section.

Figure 7:
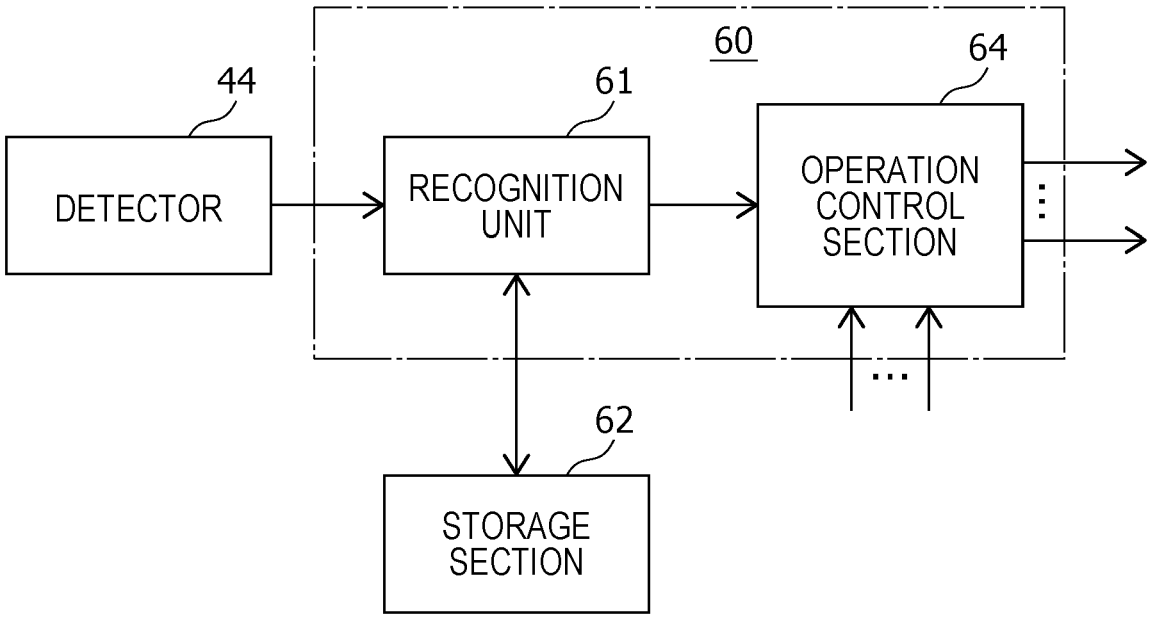
FIG. 7 is a block diagram illustrating a configuration related to document size recognition and control.

FIG. 7 illustrates a configuration for size recognition. A control section 60 is constituted of a processor that executes a program, for example. In the illustrated configuration example, the control section 60 is composed of a recognition unit 61 and an operation control section 64. The operation control section 64 controls operation of various elements in the image forming apparatus. While the control section 60 also has a function of generating an image to be displayed on a user interface, a configuration related to such a function is not illustrated in FIG. 7.

The recognition unit 61 recognizes the size of a document on the basis of an output signal from the detector 44, that is, on the basis of the density of the shading pattern at the reading point. In that event, a density table stored in a storage section 62 is referenced. Density thresholds or density ranges corresponding to the individual sizes are stored in the density table. For example, the recognition unit 61 recognizes the size in accordance with the density range to which the read density belongs. The recognized size is sent to the operation control section 64.

Figure 8:
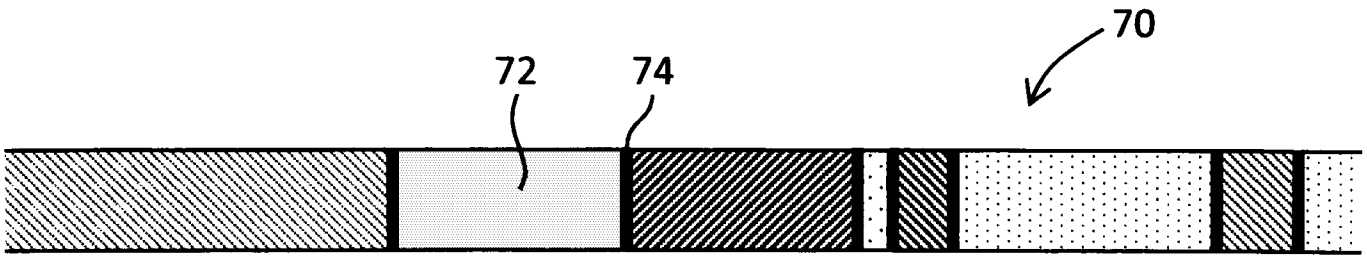
FIG. 8 illustrates a second example of the shading pattern.

A second example will be described with reference to FIGS. 8 to 10. In FIG. 8, a shading pattern 70 according to the second example is composed of a plurality of patches 72 that are similar to the plurality of patches which constitute the shading pattern according to the first example illustrated in FIG. 6. The shading pattern 70 according to the second example includes a plurality of separation bands provided between the plurality of patches. In practice, the separation bands are a plurality of black bands 74.

Figure 9:
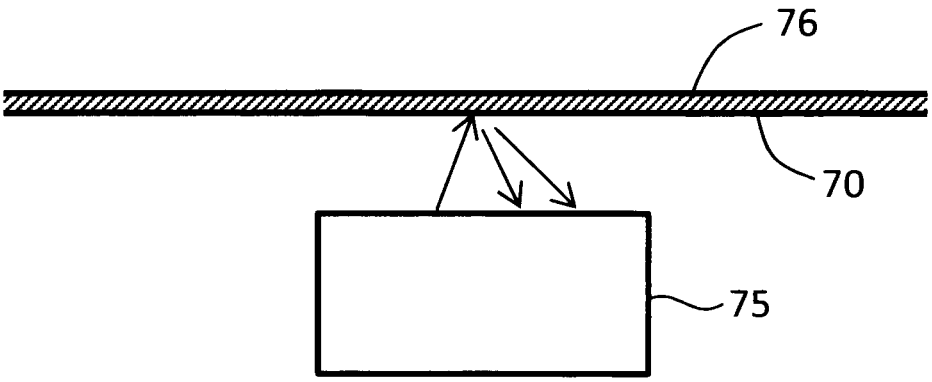
FIG. 9 illustrates a detector used for the second example.

FIG. 9 illustrates a detector 75 according to the second example. In the second example, as in the first example, the shading pattern 70 is provided on a movable piece 76. The detector 75 has a function of radiating light to a reading point, a function of detecting diffused reflected light from the reading point, and a function of detecting regularly reflected light from the reading point.

Figure 10:
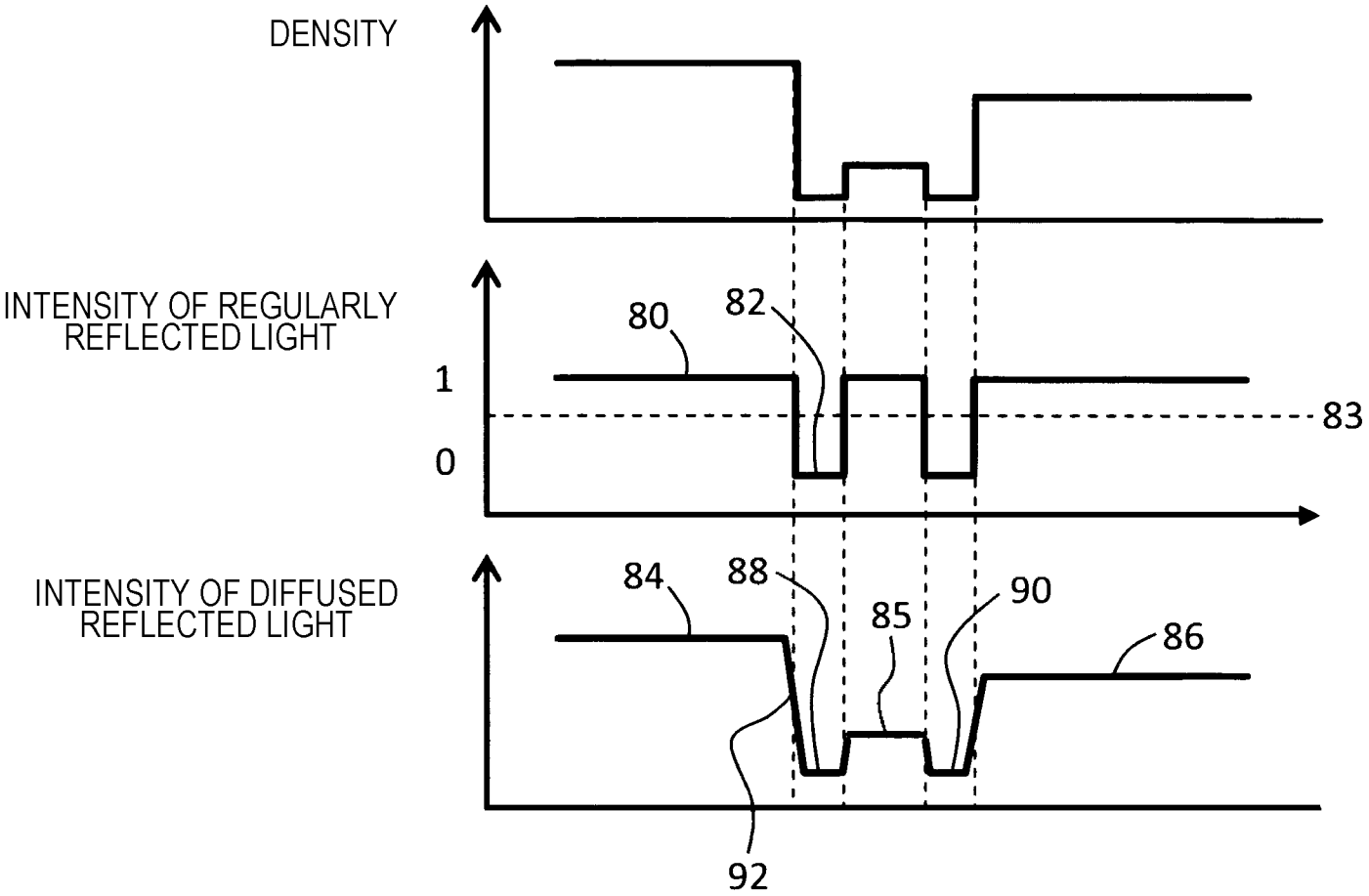
FIG. 10 illustrates a recognition method for the second example.

The upper part of FIG. 10 illustrates a density graph. The density graph indicates variations in the density in a shading pattern that includes three patches and two black bands provided between the three patches. The middle part and the lower part of FIG. 10 illustrate variations in the intensity of regularly reflected light and variations in the intensity of diffused reflected light, respectively, obtained in the case where the shading pattern is scanned at the reading point. In FIG. 10, the variations in the intensity are drawn in an exaggerated manner. The shading pattern is composed of a plurality of densities that are lower than that of the black bands.

In the variations in the intensity of scattered reflected light illustrated in the lower part, reference numerals 84, 85, and 86 indicate the densities inside the patches. The intensity is varied in accordance with the density. Conversely, the patch, that is, the size, may be recognized from the density. Reference numerals 88 and 90 indicate the density of the black bands. As indicated by reference numeral 92, the intensity is continuously varied between a patch and a black band.

In the variations in the intensity of regularly reflected light illustrated in the middle part, hill portions indicated by reference numeral 80 correspond to the patches. Valley portions indicated by reference numeral 82 correspond to the black bands. While the intensity of regularly reflected light from the black bands is considerably low, the intensity of regularly reflected light from the patches does not significantly depend on the densities to be detected, and is high to a degree. A distinction may be made between a patch and a black band (i.e. between the patches) by setting a threshold 83 and comparing the intensity of the regularly reflected light and the threshold 83.

In the second example, a first output signal obtained by detecting the diffused reflected light and a second output signal obtained by detecting the regularly reflected light are input to the recognition unit. In the case where it is determined on the basis of the second output signal that the reading point is between the patches, size recognition based on the first output signal is not performed. In the case where it is determined on the basis of the second output signal that the reading point is in a patch, size recognition based on the first output signal is executed. In the case where it is determined that the reading point is between the patches, a message indicating that the reading point is between the patches may be displayed on a user interface to prompt a user to readjust the document guides.

Also in the second example, a larger adjacent patch density difference is provided to adjacent patches corresponding to a size pair that is more likely to cause erroneous recognition. For example, the largest adjacent patch density difference is provided to adjacent patches corresponding to a size pair of sizes that are the closest to each other.

Figure 11:
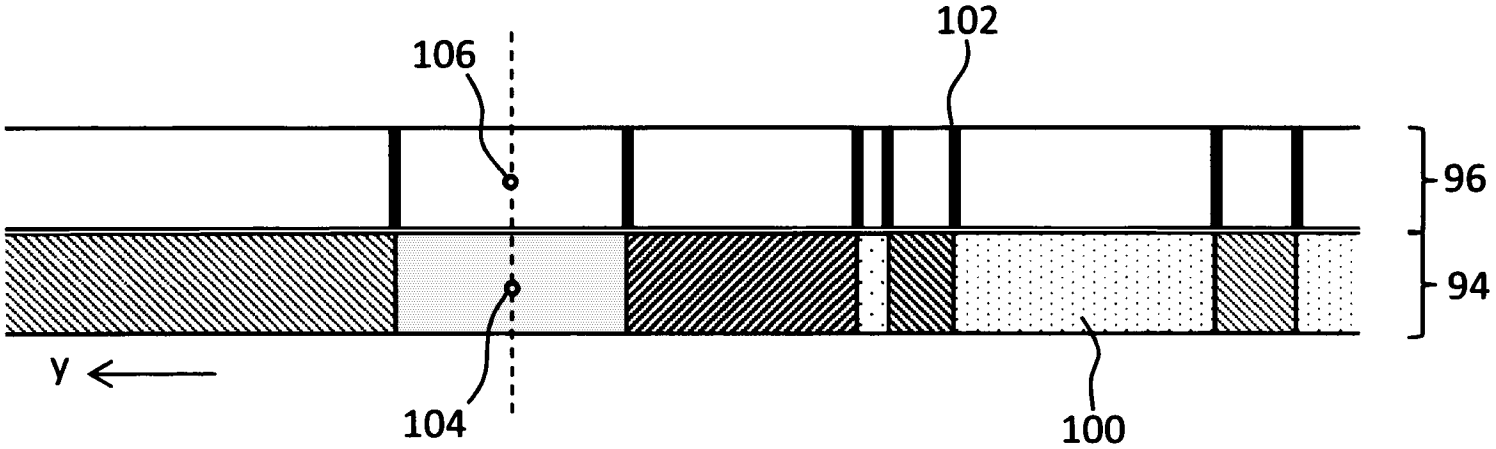
FIG. 11 illustrates a modification of the second example.

FIG. 11 illustrates a third example. The movable piece is provided with a shading pattern 94 that is the same as the shading pattern according to the first example, and an auxiliary pattern 96 that extends side by side in parallel with the shading pattern 94. The shading pattern 94 is constituted as an interconnected body of a plurality of patches 100. The shading pattern 94 does not include one or a plurality of separation bands (in practice, black bands).

The auxiliary pattern 96 includes a plurality of black bands 102. The plurality of black bands 102 are provided at a plurality of positions corresponding to locations between a plurality of adjacent patches. The black bands 102 may be provided at positions corresponding to locations between particular adjacent patches.

For example, two detectors are provided in correspondence with the shading pattern 94 and the auxiliary pattern 96, or one detector is provided to detect the densities of the shading pattern 94 and the auxiliary pattern 96. Diffused reflected light and regularly reflected light may be used in combination to detect two densities at the same time.

For example, a first reading point 104 is set on the shading pattern 94 to detect the density at the first reading point 104. A second reading point 106 is set at the same y coordinate as the first reading point 104 to detect the density at the second reading point 106. The recognition unit recognizes, on the basis of the density of the second reading point 106, whether or not the reading point is between adjacent patches. If the reading point is not between adjacent patches, size recognition is performed on the basis of the density at the first reading point 104.

Figure 12:
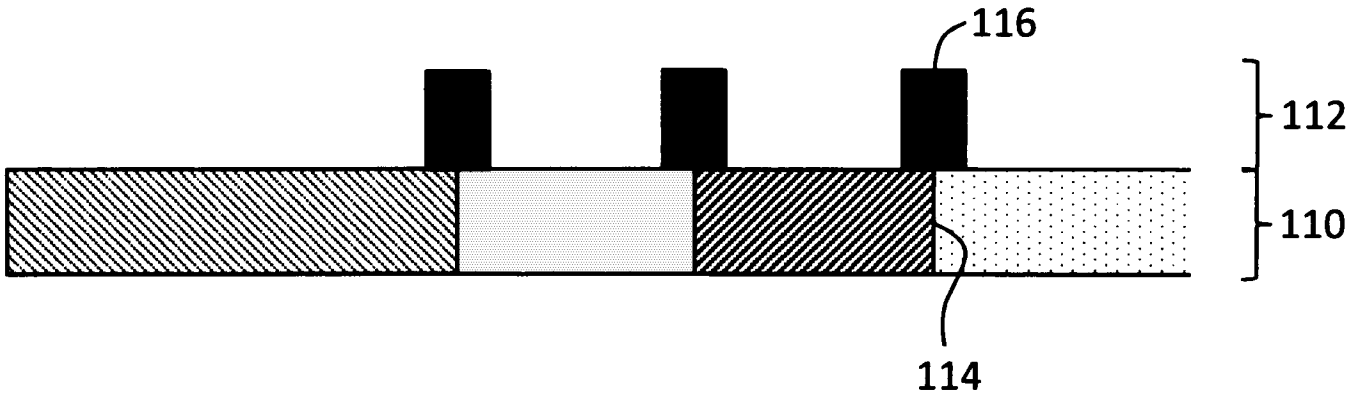
FIG. 12 illustrates another modification of the second example.

FIG. 12 illustrates another modification. A black patch row 112 is provided adjacent to a shading pattern 110. The black patch row 112 is composed of a plurality of black patches 116 corresponding to locations between a plurality of patches 114. The shading pattern 110 and the black patch row 112 are detected by two detectors or a single detector. The shading pattern 110 is constituted in accordance with certain shading rules as described above. For example, the black patches 116 are used to further enhance the recognizability between the patches 114. That is, in the case where a black patch 116 is being detected, there is a possibility that the reading point has reached a location between the patches 114. The precision in recognizing a location between the patches may be enhanced using the result of detecting a black patch. A location between the patches may be recognized as the middle position between both ends of the black patch 116 that have been detected. The black patches 116 are constituted as marks, coated films, etc. in the darkest black color, for example. From a functional point of view, the black patches 116 correspond to the separation bands.

The positional relationship among the slits, the shading pattern, and the detector discussed above is found to have a peculiar technical significance. The technical features such as the separation bands, the auxiliary pattern, and the combined use of diffused light and regularly reflected light are also found to have peculiar technical significances. Therefore, such features may be separated from other features to be adopted singly. For example, any of the features described above may be adopted on the assumption that a shading pattern according to the related art is used.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A document transport device comprising:

a placement portion configured to support a document that is placed thereon;

a slide member that includes a document guide rail that is configured to contact one lateral side of the document which is placed on the placement portion;

a movable piece connected to the slide member and including a shading pattern composed of a plurality of patches that have a plurality of densities corresponding to a plurality of document sizes and having a plurality of adjacent patch density differences that are different from each other; and a detector configured to detect a density of the shading pattern and output an output signal for document size recognition, wherein a body of the slide member is provided so as to be slidable while being pressed against a back surface of the placement portion, and the detector is fixed to the back surface of the placement portion.

2. The document transport device according to claim 1, wherein the plurality of document sizes include a particular size pair composed of two adjacent document sizes in a predetermined approximate relationship, and the shading pattern includes, as a patch pair corresponding to the particular size pair, a particular patch pair that has a particular adjacent patch density difference that is larger than an average of the plurality of adjacent patch density differences.

3. The document transport device according to claim 2, wherein the predetermined approximate relationship is the most approximate relationship, and the particular adjacent patch density difference is the largest adjacent patch density difference of the plurality of adjacent patch density differences.

4. The document transport device according to claim 1, wherein the shading pattern includes a plurality of separation bands provided between a plurality of adjacent patches.

5. The document transport device according to claim 4, wherein the separation bands are each a black band.

6. The document transport device according to claim 5, wherein the detector includes a principal light receiver that detects diffused light, and a sub light receiver that detects regularly reflected light, and a size of the document is recognized on a basis of an output signal from the principal light receiver and the sub light receiver.

7. The document transport device according to claim 1, wherein an auxiliary pattern is provided in parallel with the shading pattern, the auxiliary pattern includes a plurality of separation bands corresponding to locations between a plurality of adjacent patches, and the detector detects the density of the shading pattern and a density of the auxiliary pattern.

8. The document transport device according to claim 1, wherein the movable piece includes a front surface that faces a downstream side in a transport direction for the document and a rear surface on a side opposite to the front surface, the shading pattern is provided on the rear surface of the movable piece, and the detector is provided on a rear side of the movable piece to face the shading pattern.

9. The document transport device according to claim 1, wherein the detector is disposed on an upstream side in a transport direction for the document with respect to the shading pattern.

10. The document transport device according to claim 1, wherein the placement portion has a slit that allows passage of a part of the slide member, and the shading pattern is provided at a position shifted in a transport direction for the document from a location below the slit.

11. The document transport device according to claim 1, wherein the shading pattern is in a parallel relationship with respect to a plane defined by a direction that is orthogonal to a transport direction for the document and a direction that perpendicularly penetrates the placement portion.

12. The document transport device according to claim 1, wherein the placement portion has a slit that allows passage of a part of the slide member, the shading pattern is provided at a position shifted toward an upstream side in a transport direction for the document from a location below the slit, the detector is provided at a position further shifted toward the upstream side in the transport direction with respect to the shading pattern, and a rotary mechanism is provided at an end portion of the placement portion on a downstream side in the transport direction.

13. The document transport device according to claim 12, wherein the movable piece is provided between the slit and the detector to extend in a direction that is orthogonal to the transport direction and a direction that penetrates the placement portion.

14. An image forming apparatus comprising:

a document transport device; and a processor, wherein the document transport device includes a placement portion configured to support a document that is placed thereon, a slide member that includes a document guide rail that is configured to contact one lateral side of the document which is placed on the placement portion, a movable piece connected to the slide member and including a shading pattern composed of a plurality of patches that have a plurality of densities corresponding to a plurality of document sizes and having a plurality of adjacent patch density differences that are different from each other, and a detector configured to detect a density of the shading pattern, and wherein the processor is programed to recognize a size of the document on a basis of an output signal from the detector, a body of the slide member is provided so as to be slidable while being pressed against a back surface of the placement portion, and the detector is fixed to the back surface of the placement portion.

* * * * *